US010850820B1

(12) United States Patent
Minogue

(10) Patent No.: US 10,850,820 B1
(45) Date of Patent: Dec. 1, 2020

(54) CONTROL SYSTEM FOR MULTIPLE TROLLING MOTORS

(71) Applicant: 321 Power Systems LLC, Indian Harbour Beach, FL (US)

(72) Inventor: Sean P. Minogue, Indian Harbour Beach, FL (US)

( * ) Notice: Subject to any disclaimer, the term of this patent is extended or adjusted under 35 U.S.C. 154(b) by 0 days.

(21) Appl. No.: 16/280,815

(22) Filed: Feb. 20, 2019

Related U.S. Application Data

(60) Provisional application No. 62/636,222, filed on Feb. 28, 2018.

(51) Int. Cl.
*B63H 20/08* (2006.01)
*B63H 20/06* (2006.01)
*B63H 20/00* (2006.01)

(52) U.S. Cl.
CPC ..... *B63H 20/08* (2013.01); *B63H 20/007* (2013.01); *B63H 20/06* (2013.01)

(58) Field of Classification Search
CPC ..... B63H 20/08; B63H 20/007; B63H 20/06
See application file for complete search history.

(56) References Cited

U.S. PATENT DOCUMENTS 4,854,902 A * 8/1989 Havins ..... B63H 20/007 440/7
4,995,839 A * 2/1991 Havins ..... B63H 5/08 114/274
6,402,577 B1 * 6/2002 Treinen ..... B63H 20/12 440/61 C
9,278,745 B2 * 3/2016 Kooi, Jr. ..... F16M 13/02

* cited by examiner

*Primary Examiner* — Stephen P Avila
(74) *Attorney, Agent, or Firm* — John Rizvis; John Rizvi, P.A.—The Patent Professor®

(57) ABSTRACT

A multiple motor control system is provided for manipulating a propulsion system consisting of electric motors mounted on a water traversing vessel or watercraft. The control system incorporates a main shaft on which the electric motors are mounted and includes a steering system for turning the motors relative to the watercraft, a lifting system for raising and lowering the electric motors relative to the surface of the water and a trim mechanism for angling the direction of thrust of the electric motors so as to trim or level out the path of the watercraft as it travels through the water.

25 Claims, 8 Drawing Sheets

CONTROL SYSTEM FOR MULTIPLE TROLLING MOTORS

CROSS-REFERENCE TO RELATED APPLICATION

This application claims the benefit of U.S. Provisional Patent Application Ser. No. 62/636,222, filed on Feb. 28, 2018, which is incorporated by reference herein in its entirety.

FIELD OF THE INVENTION

The present invention relates generally to water propulsion devices, and more particularly, to a control system for manipulating two or more electric motors mounted on a water traversing vessel or watercraft.

BACKGROUND OF THE INVENTION

Many types of watercraft have been developed throughout time for recreational and non-recreational use. Many of these vessels are propelled by engines and steered or controlled by a steering wheel or similar systems. Most of these vessels utilize gasoline or diesel engines to provide sufficient power or thrust to move them through the water.

The use of gasoline and/or diesel engines in watercraft requires a certain level of caution to be operated safely, rendering them unsuitable for use by children.

Additionally, the gasoline and diesel engines generate a substantial amount of exhaust pollution as the exhaust is typically expelled under water or close to the water's surface. Oil and other fluids leaking from the engines also contribute to the polluting nature of these engines.

In many pristine areas, gasoline and diesel engines are banned leaving only wind, paddle or electric propelled vessels as options. However, while electric motors are allowed, they often lack sufficient thrust to propel a modern watercraft. Additionally, the known controlling mechanisms for these electric motors lack sufficient degrees of manipulation and orientation of their propellers relative to the water to be considered all around control devices.

Accordingly, there is an established need for a control system for operating two or more electric motors which solves at least one of the aforementioned problems.

SUMMARY OF THE INVENTION

The present invention is directed to a control system for manipulating a propulsion system consisting of electric motors mounted on a water traversing vessel or watercraft. The control system incorporates a shaft on which the electric motors are mounted and includes a steering system for turning the motors relative to the watercraft, a lifting system for raising and lowering the electric motors relative to the surface of the water and a trim mechanism for angling the direction of thrust of the electric motors so as to trim or level out the path of the watercraft as it travels through the water.

In a first implementation of the invention, a propulsion system for a watercraft includes a main shaft, and a first electric motor and a second electric motor mounted to the main shaft and configured to provide a thrust. The propulsion system further comprises a control system attached to the main shaft, the control system including a steering mechanism, a trim mechanism and a lifting mechanism. The steering mechanism is attached to the main shaft and is operable to rotate the main shaft about an axis of the main shaft. The trim mechanism is also attached to the main shaft and is operable to pivot the main shaft relative to a horizontal axis. The lifting mechanism, in turn, is also attached to the main shaft and is operable to translationally raise and lower the main shaft.

In a second aspect, the first and second electric motors can be mounted to a mounting assembly affixed to the main shaft.

In another aspect, the first and second electric motors can be mounted parallel to each other such that respective thrusts generated by the first and second electric motors are oriented in a same direction.

In another aspect, the steering mechanism can be carried by the lifting mechanism and configured to be translationally raised and lowered jointly with the main shaft.

In another aspect, the trim mechanism may be carried by the lifting mechanism and configured to be translationally raised and lowered jointly with the main shaft.

In yet another aspect, the steering mechanism can include a crank arm extending from the main shaft. The crank arm may be jointly rotatable with the main shaft about the axis of the main shaft.

In another aspect, the steering mechanism can further include a control arm pivotally connected to the crank arm such that movement of the control arm causes a joint rotation of the crank arm and main shaft about the axis of the main shaft.

In another aspect, the movement of the control arm may include a translational movement of the control arm along a transverse direction perpendicular to the axis of the main shaft.

In another aspect, the steering mechanism can include a guide body. The control arm may be slidably mounted on the guide body such that sliding of the control arm in a first direction along the guide body causes a joint rotation of the crank arm and main shaft about the axis of the main shaft in a second direction opposite the first direction.

In yet another aspect, the trim mechanism can be pivotably coupled to the guide body.

In another aspect, the propulsion system can further include a threaded bolt configured to thread into and through a portion of the trim mechanism and to press downward on a fixed surface of the propulsion system, i.e. a surface that is fixed in relation to the trim mechanism such that a threading of the threaded bolt into the portion of the trim mechanism and onto the surface is configured to cause an upward rotation of the trim mechanism and main shaft relative to the watercraft. The threaded bolt can be selectively operable to thread into or from the portion of the trim mechanism to pivot the trim mechanism and main shaft upward or downward relative to the watercraft.

In another aspect, the surface can be comprised in or provided by the lifting mechanism.

In another aspect, the lifting mechanism can include a bracket configured to mount to a watercraft and a jack plate slidably positioned within the bracket. The main shaft can be translationally movable upward and downward jointly with the jack plate.

In yet another aspect, the aforementioned fixed surface can be comprised in or provided by the jack plate.

In another aspect, the lifting mechanism can additionally include an actuator affixed to the bracket and the jack plate. The actuator may be operable to raise and lower the jack plate relative to the bracket.

In another aspect, the actuator may include a hydraulic lifter.

In another aspect, the propulsion system can be configured to be attached to a watercraft.

In yet another aspect, the bracket can be configured to mount to a back of a watercraft.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a control system that is capable of operating an electric motor propulsion system for a water vessel by rotating, lifting and pivoting a pair of electric motors relative to a transom of the vessel.

Figure 1:
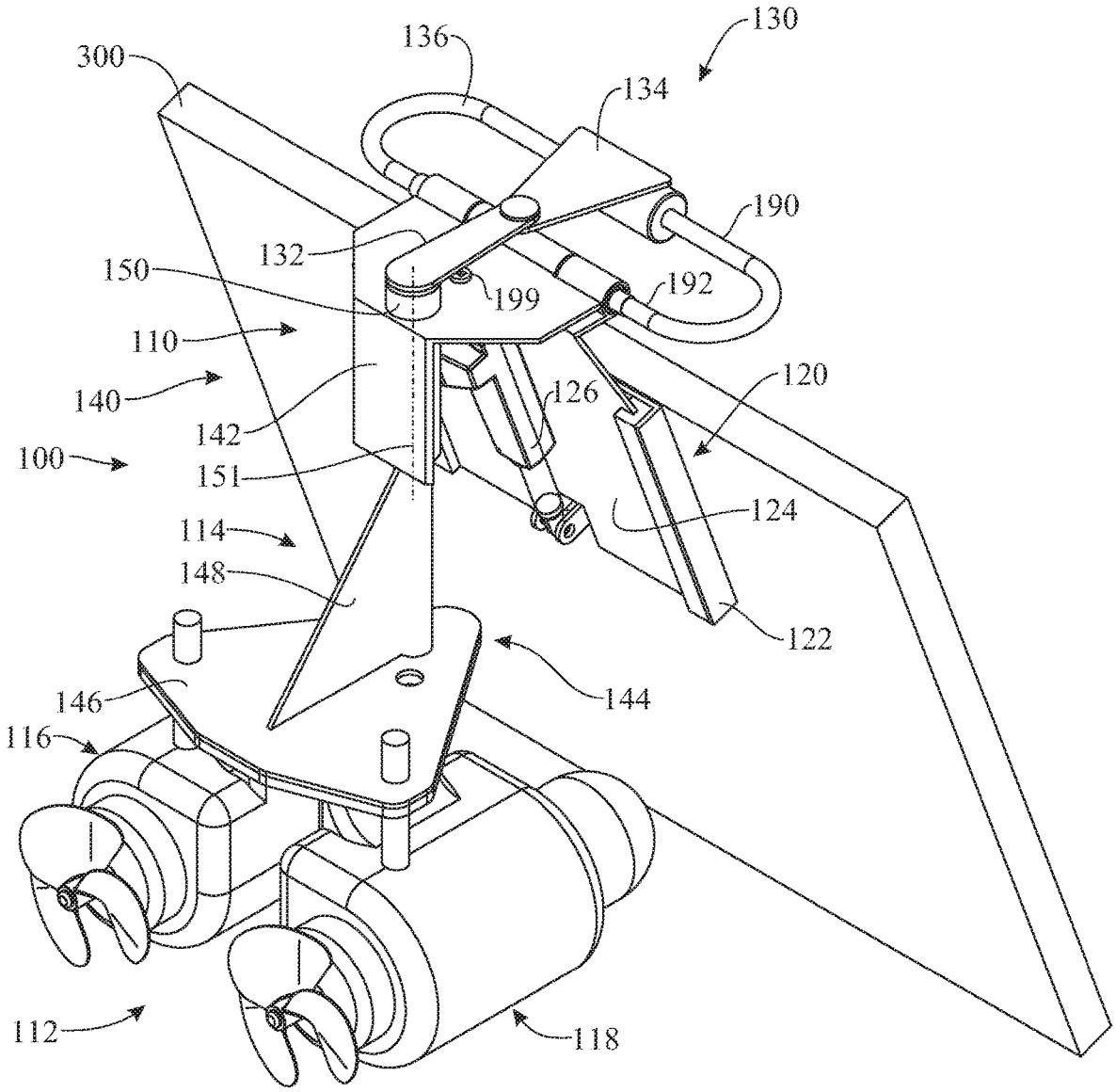
FIG. 1 presents an isometric view of a control system for multiple trolling motors in accordance with an illustrative embodiment of the present invention mounted on a transom of a boat.
Figure 2:
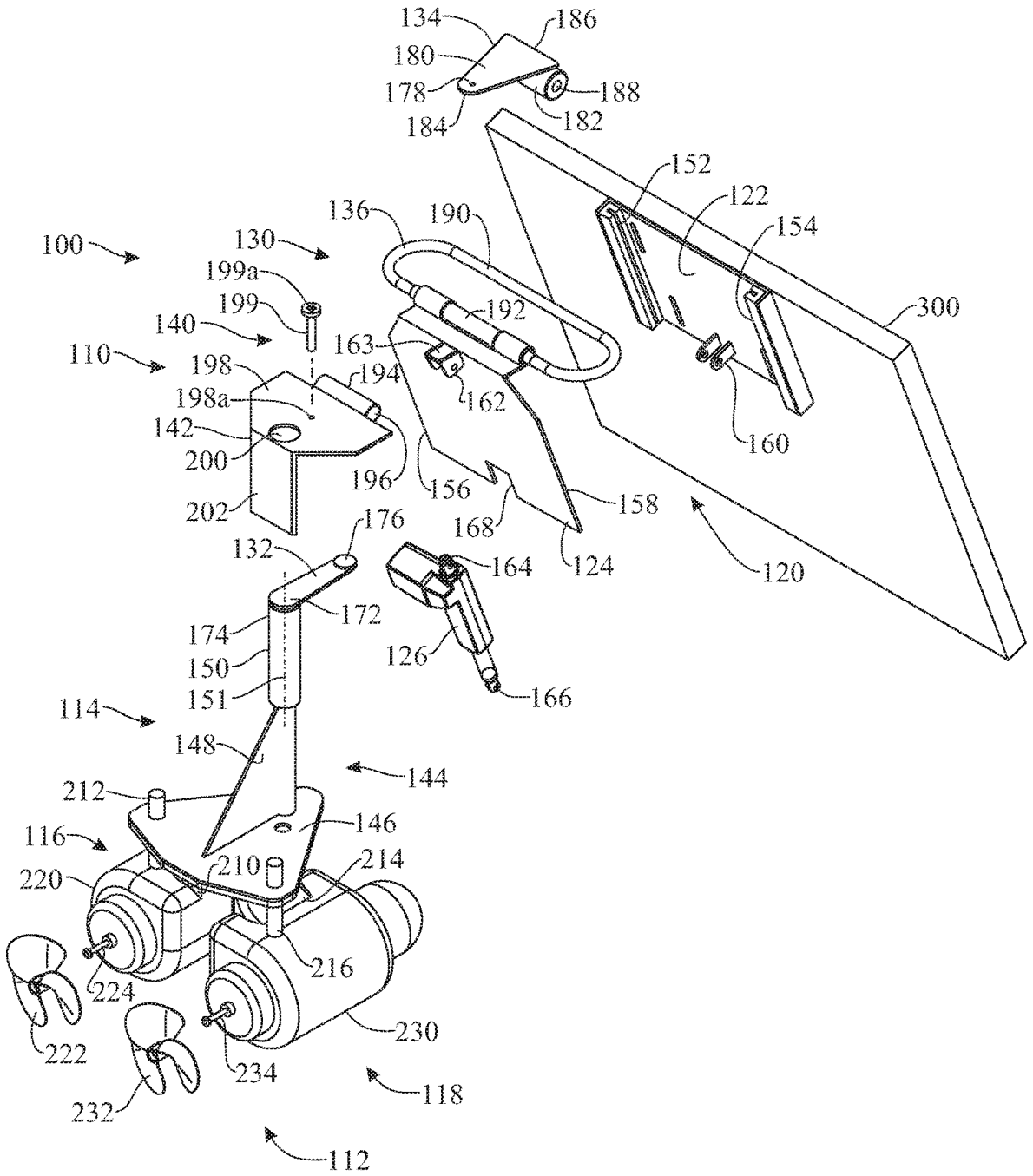
FIG. 2 presents an isometric view, with parts separated, of the control system of FIG. 1.

Referring initially to FIGS. 1 and 2, a control system for multiple trolling motors 100 is illustrated in accordance with an exemplary embodiment of the present invention, configured as a multi-dimensional control for use in movably and adjustably positioning two or more motors relative to a boat or other water vessel. As shown, the control system 100 generally includes a control assembly 110 for manipulating a propulsion system 112 relative to a back or transom 300 of a water vessel. A mounting assembly 114 connects the control assembly 110 to the propulsion system 112. The propulsion system 112 of the present embodiment generally includes a first electric motor assembly 116 and a second electric motor assembly 118 which are oriented parallel and side-by-side to each other to provide combined and increased thrust in a single direction relative to the vessel. Power for the propulsion system 112 can be provided by at least one onboard battery, generator or other applicable power source (not shown).

The control assembly 110 provides a lifting function to raise and lower or translate the propulsion system 112 relative to the transom 300 and a steering function to rotate the propulsion system 112 relative to the transom 300 to turn or steer the vessel. The control assembly 110 additionally provides a trim function to angle the propulsion system 112 relative to a horizontal or imagined water line as will be described in more detail hereinbelow.

The lifting function of the control assembly 110 is provided by a lifting mechanism 120 which includes a transom bracket 122 non-movably affixed to the transom 300 of the vessel and a sliding or jack plate 124 connected to the mounting assembly 114 and to the propulsion system 112, and slidably mounted in the transom bracket 122. A hydraulic lifter 126 is connected to both the jack plate 124 and the transom bracket 122 to slidably raise and lower the jack plate 124 within and relative to the transom bracket 122. The hydraulic lifter 126 is an electrically-operated device that is associated with and controlled by an external electronic control system (not shown).

The steering function of the control assembly 110 is provided by a steering mechanism 130 which includes a crank arm 132 rigidly connected to the mounting assembly 114 and a control arm 134 pivotally connected to the crank arm 132. By moving the control arm 134 right and left horizontally, the crank arm 132 is pivoted horizontally to turn the propulsion system 112 left and right and thus steer the boat by altering the direction of thrust from the propulsion system 112. In order to guide and support the control arm 134 in its right and left travel, the control arm 134 is slidably mounted on an oval shaped guide body 136.

The pivoting or trim function of the control assembly 110 is provided by a pivoting or trim mechanism 140 which includes an L-shaped trim plate 142 connected to the mounting assembly 114 and pivotally mounted to the oval shaped guide body 136 of the steering mechanism 130.

The mounting assembly 114, in turn, generally includes a mounting plate 144 including a horizontal plate 146 connected to the first and second electric motor assemblies 116 and 118, respectively, and a vertical plate 148 extending upward from the horizontal plate 146. A single main shaft 150 extends through the trim plate 142 of the pivoting or trim mechanism 140 and is rigidly connected to both the crank arm 132 of the steering mechanism 130 and the vertical plate 148 of the mounting assembly 114. The main shaft 150 has a shaft axis 151 about which the main shaft 150 is rotated to steer the vessel. Thus, rotational movement of the crank arm 132 of the steering mechanism 130 rotationally moves the propulsion system 112 through the main shaft 150.

Turning now specifically to FIG. 2, it can be seen that the jack plate 124 of the lifting mechanism 120 is slidably mounted in first and second grooves or channels 152 and 154 of the transom bracket 122. Specifically, first and second side edges 156 and 158 of the jack plate 124 are slidably mounted within the first and second channels 152 and 154, respectively, of the transom bracket 122.

Furthermore, the transom bracket 122 includes a lower lift mount 160 while the jack plate 124 includes an upper lift mount 162. Upper and lower ends 164 and 166 of the hydraulic lifter 126 are attached to the upper and lower lift mounts 162 and 160, respectively. Additionally, in some embodiments, the lower lift mount 160 can function as a lower stop to prevent the jack plate 124 from sliding out of the first and second channels 152 and 154. Specifically, the jack plate 124 can include a cut out stop 168 that engages the lower lift mount 160 when the jack plate 124 is in its lowest position within the first and second channels 152 and 154.

With continued reference to FIG. 2, in order to steer the associated boat or vessel, as the control arm 134 is moved in one direction, causing the control arm 134 to rotate the crank arm 132 and the main shaft 150 to be thus rotated to turn the propulsion system 112. More specifically, the crank arm 132 of the steering mechanism 130 is rigidly connected at a first end 172 thereof to an upper end 174 of the main shaft 150. A second end 176 of the crank arm 132 is pivotally connected to a pivot point 178 on the control arm 134. As noted above, the control arm 134 slides along the oval shaped guide body 136. Specifically, the control arm 134 includes a control plate 180 and a slide tube 182 affixed to the control plate 180. The pivot point 178 is located at a first end 184 of the control plate 180 and the slide tube 182 is affixed to a second end 186 of the control plate 180. The slide tube 182 defines an internal bore 188 which is slidably mounted over a first straight portion 190 of the guide body 136.

In different embodiments of the invention, different mechanisms or actuators may be included to cause the control arm 134 to slide along the first straight portion 190 of the oval shaped guide body 136. For instance and without limitation, the control arm 134 may be operated manually, or by a push-pull cable steering system or a hydraulic steering system which in turn may be user-operated by a steering wheel or other user-operable control. When the applicable mechanism exerts a sufficient lateral force on the control arm 134, the control arm 134 is slid along the first straight portion 190 of the guide body 136. As the control arm 134 moves right or left along the first straight portion 190 of the guide body 136, the control arm 134 moves the second end 176 of the crank arm 132 angularly (via the pivot point 178) relative to the shaft axis 151, causing the first end 172 of the crank arm 132 to rotate the main shaft 150 in a leftward or rightward angular rotation about the shaft axis 151, thereby turning the propulsion assembly 112 left and right to steer the vessel.

In turn, the pivoting or trim mechanism 140 of the control assembly 110 mainly comprises a threaded bolt 199 which adjustably extends through an opening **198*a* in the horizontal plate 198 of the L-shaped trim plate 142. In different embodiments of the invention, the threaded bolt 199 can be manually or automatically operated to cause the threaded bolt 199 to selectively thread into or outward from the opening 198*a*. For instance and without limitation, the threaded bolt 199 can include a bolt head having a non-rotational element 199*a* (for example, a polygonal cavity, as shown, or a polygonal outside contour of the bolt head) allowing to exert a torque on the bolt head. In order to tilt the propulsion system 112 in and out relative to the surface of the water, and thus trim the vessel, the L-shaped trim plate 142 is rotated about a second straight portion 192 of the guide body 136, wherein the second straight portion 192 is generally parallel to and spaced apart from the aforementioned first straight portion 190 of the guide body 136. Specifically, as shown in FIG. 2, the trim plate 142 includes a rotator tube 194, defining an internal bore 196 which is rotatably mounted on the second straight portion 192. The trim plate 142 further includes a horizontal plate 198, defining a hole 200 for receipt of the main shaft 150, and an outer, vertical plate 202 for support and protection of the main shaft 150. By threading the threaded bolt 199 into the opening 198*a*, the distal end of the threaded bolt 199 presses downward on the contacting wall or surface 163 of the upper lift mount 162. Because the upper lift mount 162 is fixed, downward threading of the threaded bolt 199 causes the opening 198*a*, and thus the horizontal plate 198 and the remainder of the L-shaped trim plate 142 to rotate upward. Upward rotation of the L-shape trim plate 142 draws the mounting assembly 114 upward, with the control arm 134 pivoting about the first straight portion 190 of the oval shaped guide body 136 and the horizontal plate 198 of the L-shaped trim plate 142 pivoting about the second straight portion 192 of the oval shaped guide body 136. This pivoting or trim mechanism 140 allows an operator to tilt or trim the propulsion system 112 in or out relative to the transom of the vessel. While not specifically shown, a bearing may be incorporated into the hole 200 in the horizontal plate 198 for support of the main shaft 150 to facilitate rotation of the main shaft 150 relative to the horizontal plate 198 about the shaft axis 151. It should be noted that the jack plate 124 is rigidly connected to the second straight portion 192 of the guide body 136**.

In some embodiments, a removable pin may extend transversely through the distal end of the threaded bolt 199 to keep the motors from "kicking up", i.e. causing an upward pivoting of the pivoting or trim mechanism 140, when operated in reverse. In some embodiments, an actuated pin may extend transversely through the distal end of the threaded bolt 199 to allow the motors to "kick up" when operated in forward if the motors hit an object; the actuated pin can engage the threaded bolt 199 when the motors operate in reverse to prevent the motors from lifting up.

The components of the control assembly 110 may be manufactured from a variety of materials including acetate and aluminum, composites or reinforced fiber, etc.

Turning now for the moment to the propulsion system 112, or driving function, and with continued reference to FIG. 2, in the present embodiment, the first and second electric motor assemblies 116 and 118 are secured in a fixed position to the horizontal plate 146 of the mounting plate 144. The first electric motor assembly 116 is secured to the horizontal plate 146 by a first mounting bracket 210 and a first through bolt 212 and the second electric motor assembly 118 is secured to the horizontal plate 146 by a second mounting bracket 214 and a second through bolt 216.

However, alternative embodiments are contemplated. For instance, in some embodiments of the invention, the first and second mounting brackets 210 and 214 may be omitted.

The first and second electric motor assemblies 116 and 118, respectively, are connected to and powered by an electronic control system associated with the vessel (not shown). The first electric motor assembly 116 includes a first electric motor 220 having a first propeller 222 mounted on a first drive shaft 224 of the first electric motor 220. Similarly, the second electric motor assembly 118 includes a second electric motor 230 having a second propeller 232 mounted on a second drive shaft 234 of the second electric motor 230. The first and second motor assemblies 116 and 118 are designed to be controlled and operated together by simultaneously rotating the respective first and second propellers 222 and 232. As noted hereinabove, an onboard power source is provided to power the first and second electric motors 220 and 230. Throttle or speed control of the first and second electric motors 220 and 230 is also provided to operate the first and second electric motors 220 and 230 at identical speeds and, in different embodiments of the invention, in identical or opposite directions.

Figure 3:
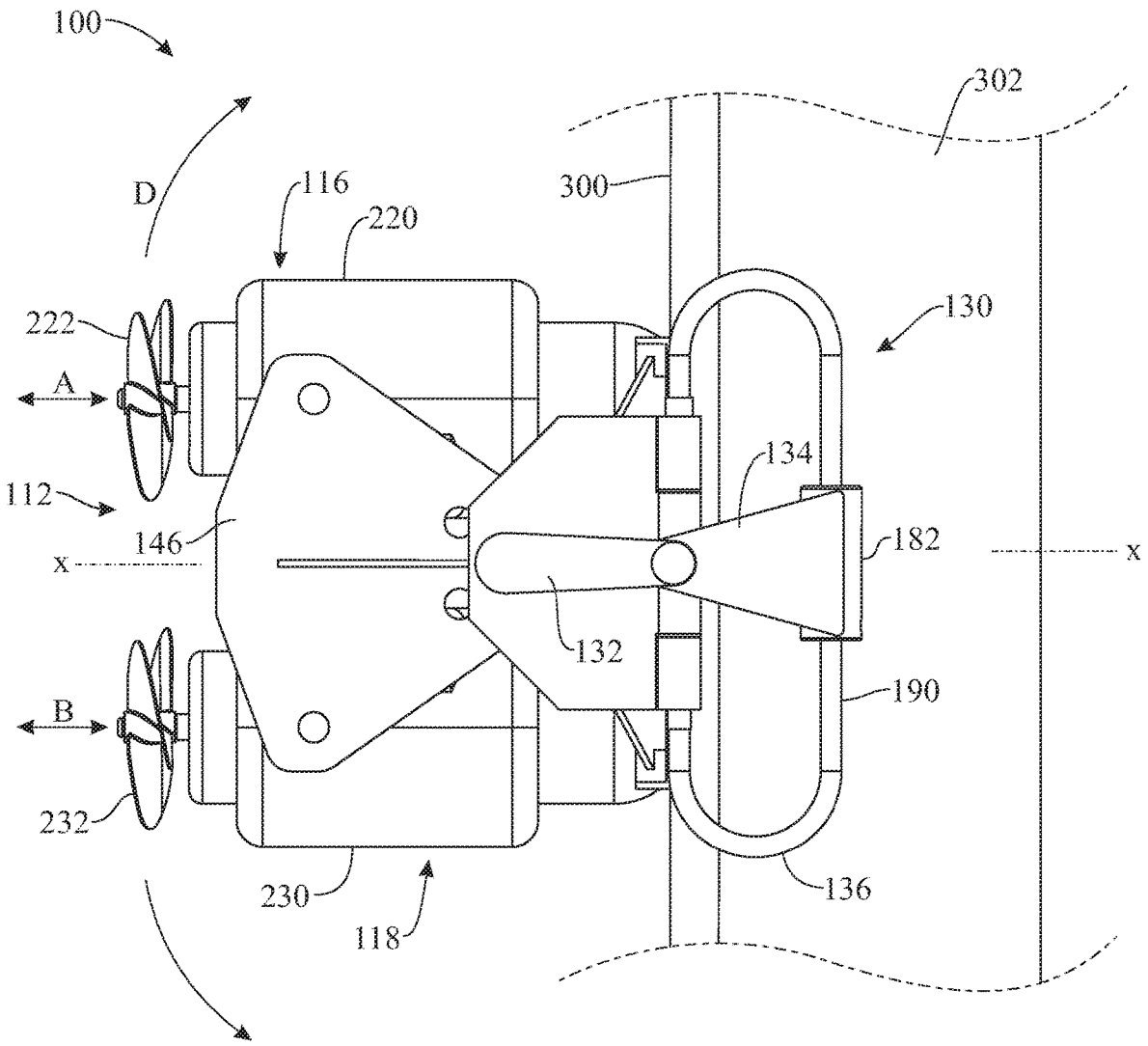
FIG. 3 presents a top plan view of the control system of the present invention positioned in a central or straight-line position.

Turning now to FIGS. 3-8, and initially with regard to FIG. 3, the driving function, the steering function, the pivoting or trim function and the lifting function of the control assembly 110 to operate and manipulate the propulsion system 112 relative to the vessel (not shown) will now be described. As noted above, the first and second electric motor assemblies 116 and 118 are fixed relative to the mounting assembly 114 (FIG. 2) and, in particular, to the horizontal plate 146 of the mounting assembly 114. Thus, thrust generated in the direction of arrow "A" from the first electric motor assembly 116 is parallel to the thrust generated in direction "B" from the second electric motor assembly 118.

In one embodiment, the first and second propellers 222 and 232 counter rotate, i.e. rotate in opposite directions relative to one another. These two propellers preferably also rotate at identical speeds to produce thrust in the same direction but, due to the counter-rotation, eliminate any side to side torque as may be present with commonly rotated propellers, i.e., propellers that rotate simultaneously in the same direction torqueing or pulling the transom 300 right or left. Having two propellers producing identical thrust levels in the same direction allows the control system for multiple trolling motors 100 to produce greater thrust than a single-motor system allowing it to function as a primary propulsion source. Additionally, the dual-motor nature of this system provides safety in the form of redundancy to allow a user to return to port should one of the motors in the system fail or have a malfunction.

Figure 4:
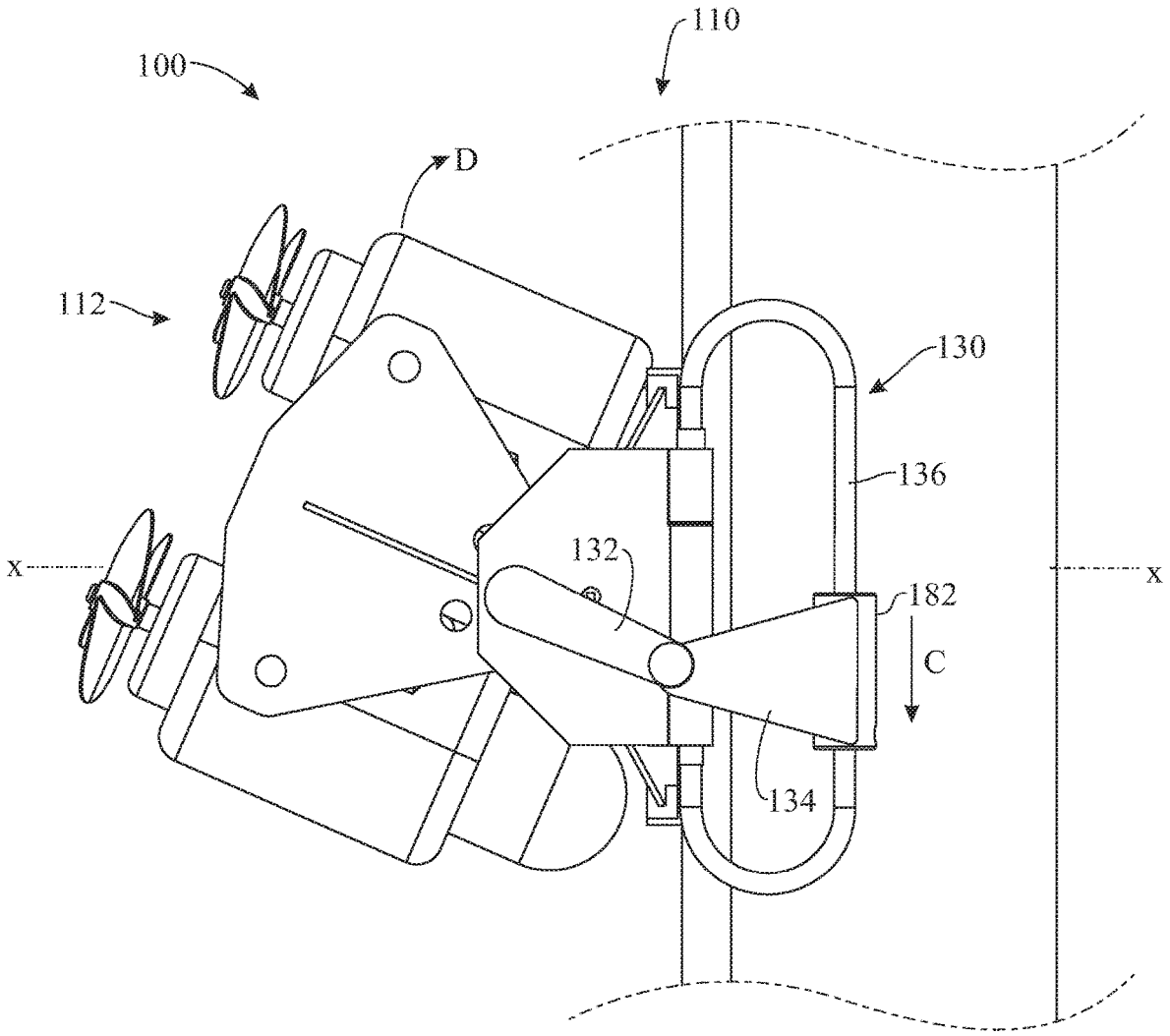
FIG. 4 presents a top plan view of the control system of the present invention with a trolling motor assembly rotated to one side.
Figure 5:
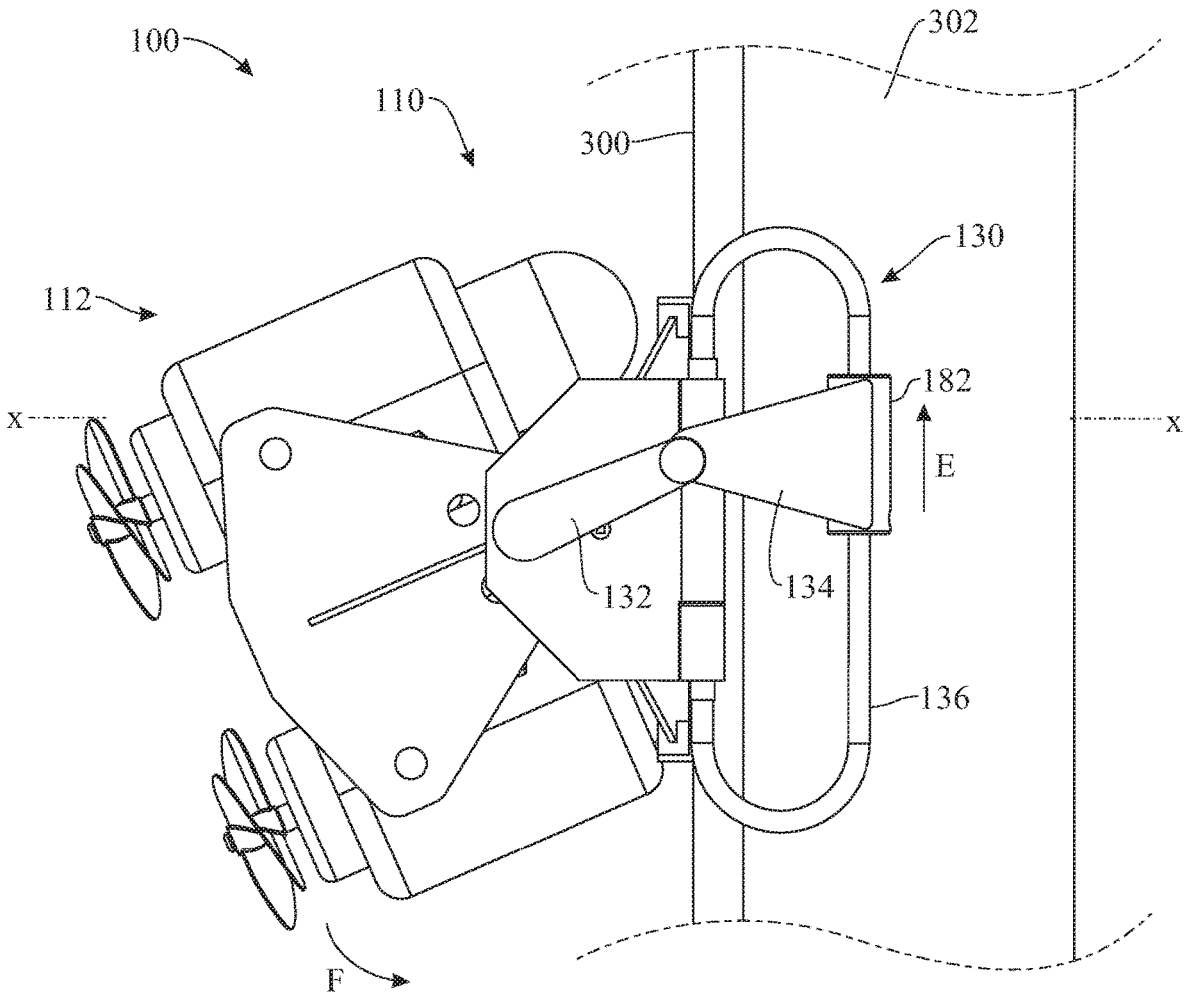
FIG. 5 presents a top plan view of the control system of the present invention with the trolling motor assembly rotated to an opposite side.

Turning now to FIGS. 3-5, the steering function and steering mechanism 130 of the control assembly 110 will now be described. The illustration of FIG. 3 shows the propulsion system 112, including the first and second electric motor assemblies 116 and 118, aligned with a longitudinal axis x-x of a vessel 302 containing the transom 300. The control arm 134 is centered on the first straight portion 190 of the oval-shaped guide body 136 and the crank arm 132 is in line with the control arm 136 and the longitudinal axis x-x of the vessel 302. In this orientation, the control assembly 110 allows the vessel 302 to be driven in a straight line along its longitudinal axis x-x in either a forward or backward direction.

When an operator wishes to turn the vessel 302, the control arm 134 is moved to the right or left along the first straight portion 190 of the guide body 136 either manually or by remote operation to force the propulsion system 112 to rotate to the left or right, respectively, as described hereinabove. For example, with regard to FIGS. 3 and 4, should the operator wish to turn the vessel 302 to the left as it travels forward, the control arm 134 is moved to the right in the direction of arrow "C" to turn or rotate the propulsion assembly 112 to the left relative to the longitudinal axis x-x (i.e. in the direction of arrow "D"). Specifically, as the control arm 134 is moved to the right along the guide body 136, the crank arm 132 is rotated in the clockwise direction about the shaft axis 151, rotating the main shaft 150 (FIG. 2) in the clockwise direction to turn the propulsion assembly 112 to the left in the direction of arrow "D". This steers and drives the vessel 302 around to the left.

Conversely, with respect to FIGS. 3 and 5, should the operator desire to turn the vessel to the right, the control arm 134 is moved to the left in the direction of arrow "E" which in turn rotates the propulsion assembly 112 to the right in the direction of arrow "F" relative to the longitudinal axis x-x and steer and drive the vessel 302 to the right. Specifically, as the control arm 134 is moved to the left along the guide body 136, the crank arm 132 is rotated in a counterclockwise manner to rotate the main shaft 150 counterclockwise and thus turn the propulsion assembly 112 to the right in the direction of arrow "F". In this manner, the disclosed control system 100 functions to simultaneously turn the first and second motor assemblies 116 and 118, respectively, in the same direction to steer the vessel 302 and with an increased or doubled amount of thrust to propel the vessel 302 through the water.

Figure 6:
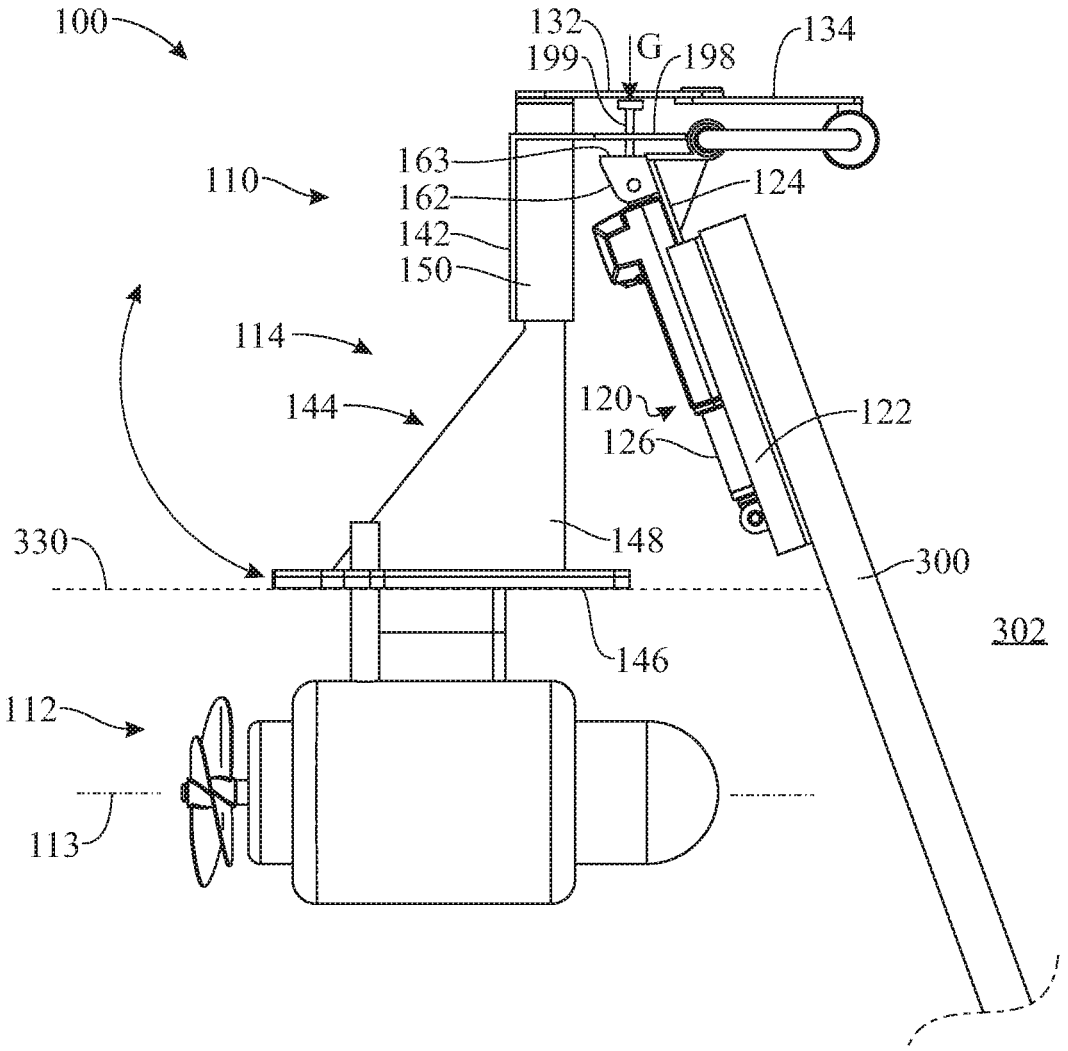
FIG. 6 presents a side elevation view of the control system of FIG. 1 with the control system and trolling motor assembly in a lowered position.
Figure 7:
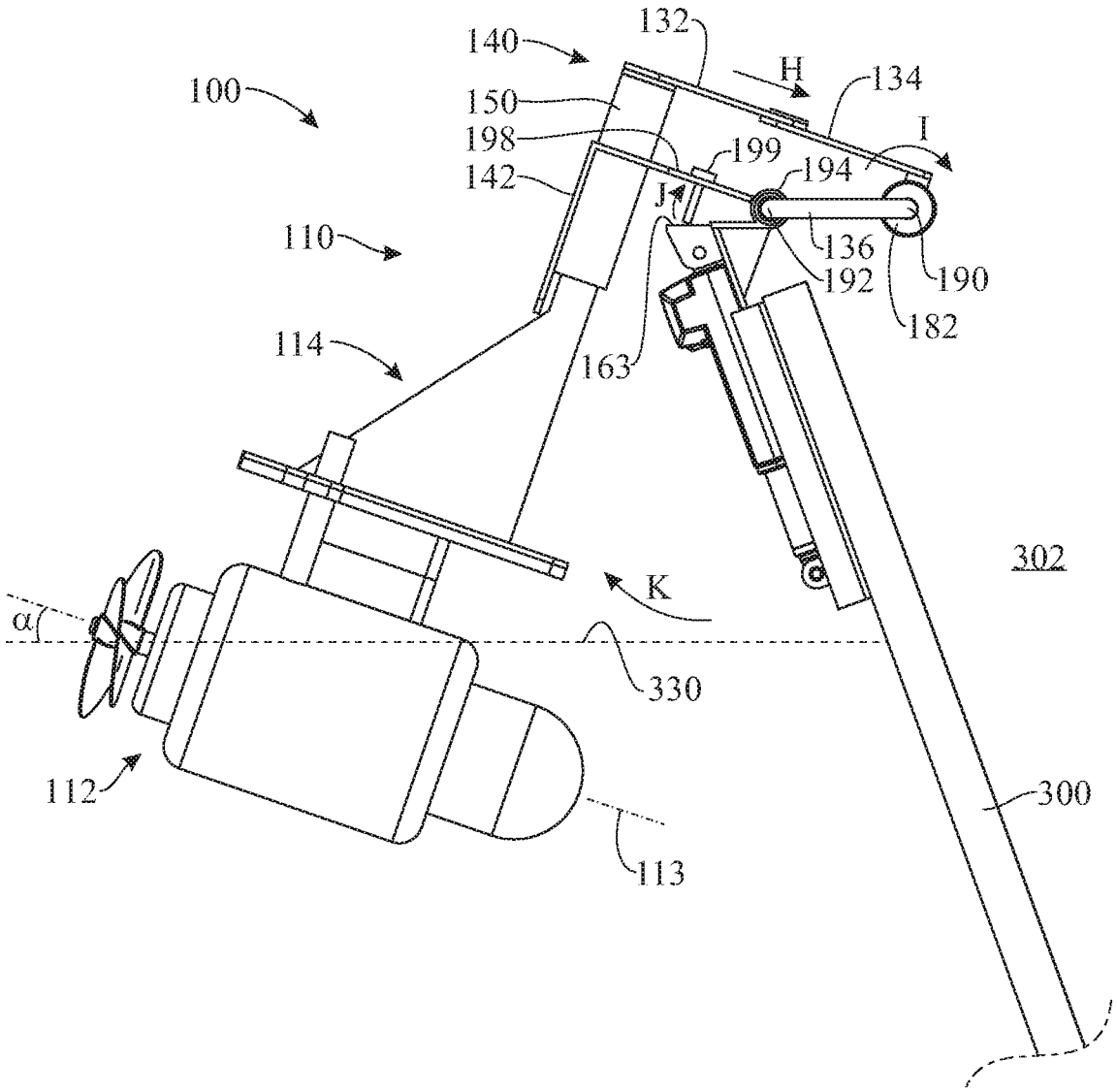
FIG. 7 presents a side elevation view similar to FIG. 6 with the control system and trolling motor assembly pivoted to an upward position.

Turning now to FIGS. 6 and 7, and initially with regard to FIG. 6, the operation of the tilt or trim function and, in particular the pivoting or trim mechanism 140 of the control system for multiple electrical motors 100 is illustrated. As shown, the mounting assembly 114 is initially in a vertical position. Specifically, the main shaft 150 and the vertical plate 148 of the mounting plate 144 are in a vertical position and the horizontal plate 146 of the mounting 144 is in a horizontal position. The crank arm 132 and the control arm 134 are also in a horizontal position. This positions a drive axis 113 of the propulsion assembly 112 parallel to a water surface or water line 330 to drive the vessel 302 relatively level through the water.

Should the operator wish to raise the bow of the vessel 302 and "trim" the vessel 302, a torque is applied onto the threaded bolt 199 causing the threaded bolt 199 to rotate relative to the threaded opening 198*a* in the horizontal plate 198 and advance forward (downward) in the direction of arrow "G". Once the distal end of the threaded bolt 199 contacts the contacting wall or surface 163 of the upper lift mount 162, further rotation of the threaded bolt 199 causes the horizontal plate 198 of the L-shaped trim plate 142 (and thus the entire L-shaped trim plate 142) to rotate upward about the second straight portion 192 of the oval shaped guide body 136, as indicated in FIG. 7 by arrow "J". This pulls on the main shaft 150 upward, which in turn draws the crank arm 132 and control arm 134 forward in the direction of arrow "H" and causes the slide tube 182 of the control arm 134 to rotate around the first straight portion 190 of the guide body 136. The lifting of the main shaft 150, crank arm 132 and control arm 134 and their rotation about the first straight portion 190 of the guide body 136 causes the mounting assembly 114 and the propulsion assembly 112 also to be rotated clockwise in the direction of arrow "K" about the first straight portion 190 of the guide body 136. This positions the drive axis 113 at an angle $\alpha$ relative to the water line 330 to trim the vessel 302. Unthreading the threaded bolt 199 outward of the threaded opening 198*a* reverses the process to lower and rotate the propulsion assembly 112 back down to a desired position.

Figure 8:
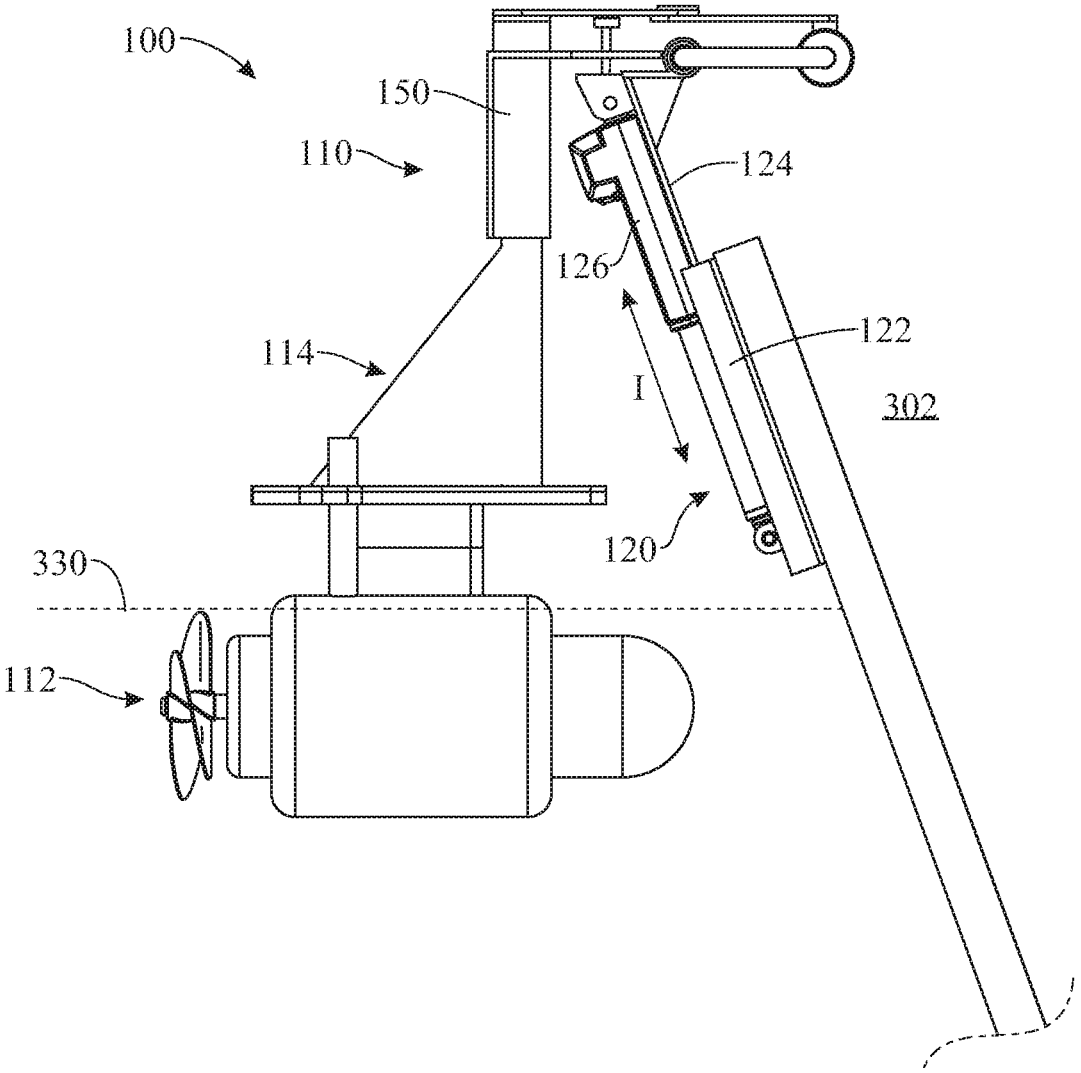
FIG. 8 presents a side elevation view of the control system of FIG. 1 with the control system and trolling motor assembly vertically translated to a raised position.

Referring now to FIGS. 6 and 8, the operation of the lifting function and lifting mechanism 120 is illustrated. As shown in FIG. 6, the jack plate 124 is in its lowest position within the transom bracket 122. To raise the propulsion assembly 112 relative to the water line 330 without altering the angle of the drive axis 113 of the propulsion assembly 112, the hydraulic lifter 126 is actuated to raise the jack plate 124 in the direction of arrow "I" within the transom bracket 122 (FIG. 8). This raises the control assembly 110, the main shaft 150, the mounting assembly 114 and the propulsion assembly 112. To lower the propulsion assembly 112 relative to the water line 330, the hydraulic lifter 126 is actuated in the opposite direction. In an alternative embodiment, the lifting mechanism 120 may employ a pneumatic, completely electric or other lifting mechanism or actuator, rather than hydraulic lifting device. For example, a completely electric lifting mechanism may incorporate an electric motor and gears and racks, etc.

It should be noted that both the trim mechanism 140 and the lifting mechanism 120 may be operated independently or together to completely raise at least the first and second propellers 222 and 232, respectively, out of the water.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A propulsion system for a watercraft, comprising:
- a main shaft;
- a first electric motor and a second electric motor mounted to the main shaft, and configured to provide a thrust;
- a control system attached to the main shaft, the control system including:
  - a steering mechanism attached to the main shaft and operable to rotate the main shaft about an axis of the main shaft,
  - a trim mechanism attached to the main shaft and operable to pivot the main shaft relative to a horizontal axis, and
  - a lifting mechanism attached to the main shaft and operable to translationally raise and lower the main shaft; and
- a threaded bolt configured to thread into and through the a portion of the trim mechanism and to press downward on a surface of the propulsion system, wherein the surface is fixed in relation to the trim mechanism such that a threading of the threaded bolt into the portion of the trim mechanism and onto the surface is configured to cause an upward rotation of the trim mechanism and main shaft relative to the watercraft, and further wherein the threaded bolt is selectively operable to thread into or from the portion of the trim mechanism to pivot the trim mechanism and main shaft upward or downward relative to the watercraft.

2. The propulsion system of claim 1, wherein the first and second electric motors are mounted to a mounting assembly affixed to the main shaft.

3. The propulsion system of claim 1, wherein the first and second electric motors are mounted parallel to each other such that respective thrusts generated by the first and second electric motors are oriented in a same direction.

4. The propulsion system of claim 1, wherein the steering mechanism is carried by the lifting mechanism and configured to be translationally raised and lowered jointly with the main shaft.

5. The propulsion system of claim 1, wherein the trim mechanism is carried by the lifting mechanism and configured to be translationally raised and lowered jointly with the main shaft.

6. The propulsion system of claim 1, wherein the steering mechanism comprises a crank arm extending from the main shaft and jointly rotatable with the main shaft about the axis of the main shaft.

7. The propulsion system of claim 6, wherein the steering mechanism further comprises a control arm pivotally connected to the crank arm such that movement of the control arm causes a joint rotation of the crank arm and main shaft about the axis of the main shaft.

8. The propulsion system of claim 7, wherein the movement of the control arm comprises a translational movement of the control arm along a transverse direction perpendicular to the axis of the main shaft.

9. The propulsion system of claim 7, wherein the steering mechanism comprises a guide body, and further wherein the control arm is slidably mounted on the guide body such that sliding of the control arm in a first direction along the guide body causes a joint rotation of the crank arm and main shaft about the axis of the main shaft in a second direction opposite the first direction.

10. The propulsion system of claim 9, wherein the trim mechanism is pivotably coupled to the guide body.

11. The propulsion system of claim 1, wherein the surface is comprised in the lifting mechanism.

12. The propulsion system of claim 11, wherein the lifting mechanism comprises a bracket configured to mount to a watercraft and a jack plate slidably positioned within the bracket, wherein the main shaft is translationally movable upward and downward jointly with the jack plate, and further wherein the surface is comprised in the jack plate.

13. The propulsion system of claim 1, wherein the lifting mechanism comprises a bracket configured to mount to a watercraft and a jack plate slidably positioned within the bracket, wherein the main shaft is translationally movable upward and downward jointly with the jack plate.

14. The propulsion system of claim 13, wherein the lifting mechanism further comprises an actuator affixed to the bracket and the jack plate, the actuator operable to raise and lower the jack plate relative to the bracket.

15. The propulsion system of claim 14, wherein the actuator comprises a hydraulic lifter.

16. The propulsion system of claim 13, wherein the bracket is configured to mount to a back of a watercraft.

17. The propulsion system of claim 1, wherein the propulsion system is configured to be attached to a watercraft.

18. A propulsion system for a watercraft, comprising:
- a main shaft;
- a first electric motor and a second electric motor mounted to the main shaft, and configured to provide a thrust; and
- a control system attached to the main shaft, the control system including:
  - a steering mechanism attached to the main shaft and operable to rotate the main shaft about an axis of the main shaft, a trim mechanism attached to the main shaft and operable to pivot the main shaft relative to a horizontal axis, and a lifting mechanism attached to the main shaft and operable to translationally raise and lower the main shaft; wherein the steering mechanism is carried by the lifting mechanism and configured to be translationally raised and lowered jointly with the main shaft; and further wherein the trim mechanism is carried by the lifting mechanism and configured to be translationally raised and lowered jointly with the main shaft; and a threaded bolt configured to thread into and through the a portion of the trim mechanism and to press downward on a surface of the propulsion system, wherein the surface is fixed in relation to the trim mechanism such that a threading of the threaded bolt into the portion of the trim mechanism and onto the surface is configured to cause an upward rotation of the trim mechanism and main shaft relative to the watercraft, and further wherein the threaded bolt is selectively operable to thread into or from the portion of the trim mechanism to pivot the trim mechanism and main shaft upward or downward relative to the watercraft.

19. A propulsion system for a watercraft, comprising:

a main shaft;

a first electric motor and a second electric motor mounted to the main shaft, and configured to provide a thrust; and a control system attached to the main shaft, the control system including:

a steering mechanism attached to the main shaft and operable to rotate the main shaft about an axis of the main shaft, a trim mechanism attached to the main shaft and operable to pivot the main shaft relative to a horizontal axis, and a lifting mechanism attached to the main shaft and operable to translationally raise and lower the main shaft; wherein the steering mechanism comprises a crank arm extending from the main shaft and jointly rotatable with the main shaft about the axis of the main shaft.

20. The propulsion system of claim 19, wherein the steering mechanism further comprises a control arm pivotally connected to the crank arm such that movement of the control arm causes a joint rotation of the crank arm and main shaft about the axis of the main shaft.

21. The propulsion system of claim 20, wherein the movement of the control arm comprises a translational movement of the control arm along a transverse direction perpendicular to the axis of the main shaft.

22. The propulsion system of claim 20, wherein the steering mechanism comprises a guide body, and further wherein the control arm is slidably mounted on the guide body such that sliding of the control arm in a first direction along the guide body causes a joint rotation of the crank arm and main shaft about the axis of the main shaft in a second direction opposite the first direction.

23. The propulsion system of claim 22, wherein the trim mechanism is pivotably coupled to the guide body.

24. A propulsion system for a watercraft, comprising:

a main shaft;

a first electric motor and a second electric motor mounted to the main shaft, and configured to provide a thrust; and a control system attached to the main shaft, the control system including:

a steering mechanism attached to the main shaft and operable to rotate the main shaft about an axis of the main shaft, a trim mechanism attached to the main shaft and operable to pivot the main shaft relative to a horizontal axis, and a lifting mechanism attached to the main shaft and operable to translationally raise and lower the main shaft; wherein the lifting mechanism comprises a bracket configured to mount to a watercraft and a jack plate slidably positioned within the bracket, wherein the main shaft is translationally movable upward and downward jointly with the jack plate; and wherein the lifting mechanism further comprises an actuator affixed to the bracket and the jack plate, the actuator operable to raise and lower the jack plate relative to the bracket.

25. The propulsion system of claim 24, wherein the actuator comprises a hydraulic lifter.

* * * * *